US008639501B2

(12) United States Patent
Karlsson et al.

(10) Patent No.: US 8,639,501 B2
(45) Date of Patent: Jan. 28, 2014

(54) METHOD AND ARRANGEMENT FOR ENHANCING SPATIAL AUDIO SIGNALS

(75) Inventors: Erlendur Karlsson, Uppsala (SE); Sebastian de Bachtin, Stockholm (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 898 days.

(21) Appl. No.: 12/665,812

(22) PCT Filed: Dec. 21, 2007

(86) PCT No.: PCT/SE2007/051077

§ 371 (c)(1), (2), (4) Date: Dec. 21, 2009

(87) PCT Pub. No.: WO2009/002245

PCT Pub. Date: Dec. 31, 2008

(65) Prior Publication Data

US 2010/0217585 A1 Aug. 26, 2010

Related U.S. Application Data

(60) Provisional application No. 60/929,440, filed on Jun. 27, 2007.

(51) Int. Cl.
*G10L 19/12* (2013.01)

(52) U.S. Cl.
USPC ..... 704/219

(58) Field of Classification Search
USPC ..... 704/219, 221, 228
See application file for complete search history.

(56) References Cited

U.S. PATENT DOCUMENTS

| | | | | |
|---|---|---|---|---|
| 5,864,798 | A | 1/1999 | Miseki et al. | |
| 7,529,663 | B2 * | 5/2009 | Byun et al. | 704/223 |
| 8,032,363 | B2 * | 10/2011 | Chen et al. | 704/225 |
| 2005/0165603 | A1 * | 7/2005 | Bessette et al. | 704/200.1 |
| 2006/0100859 | A1 * | 5/2006 | Jelinek et al. | 704/201 |

FOREIGN PATENT DOCUMENTS

| | | | |
|---|---|---|---|
| EP | 0593850 | A2 | 6/1993 |
| WO | WO 03102923 | A2 | 12/2003 |

OTHER PUBLICATIONS

Chan, C.-F. et al.: "Frequency Domain Postfiltering for Multiband Excited Linear Predictive Coding of Speech", Electronics Letters. vol. 32, No. 12, pp. 1061-1063, Jun. 6, 1996.

Ghaemmaghami, S. et al.: "Formant Detection Through Instantaneous-Frequency Estimation Using Recursive Least Square Algorithm" Signal Processing and its Applications, 1996. ISSPA 96, 4th International Symposium, vol. 1, pp. 81-84, Aug. 25-30, 1996.

* cited by examiner

*Primary Examiner* — Abul Azad

(57) ABSTRACT

In a method of enhancing spatial audio signals, receiving (S10) an ACELP coded signal comprising a plurality of blocks. For each received block estimating (S20) a signal type based on at least one of the received signal and a set of decoder parameters, estimating (S30) a pitch frequency based on at least one of the received signal and the set of decoder parameters, and determining (S40) filtering parameters based on at least one of the estimated signal type and the estimated pitch frequency. Finally, high pass filtering (S50) the received signal based on the determined filter parameters to provide a high pass filtered output signal.

12 Claims, 5 Drawing Sheets

METHOD AND ARRANGEMENT FOR ENHANCING SPATIAL AUDIO SIGNALS

This application claims the benefit of U.S. Provisional Application No. 60/929,440, filed Jun. 27, 2007, the disclosure of which is fully incorporated herein by reference.

TECHNICAL FIELD

The present invention relates to stereo recorded and spatial audio signals in general, and specifically to methods and arrangements for enhancing such signals in a teleconference application.

BACKGROUND

A few hours face-to-face meeting between parties located at different geographical locations has proven to be a very effective way of building lasting business relations, getting a project group up to speed, exchanging ideas and information and much more. The drawback with such meetings is the big overhead that goes to travel and possibly even overnight lodging, which often makes these meetings too expensive and cumbersome to arrange. Much would be gained if a meeting could be arranged so that each party could participate in the meeting from their own geographical location and the different parties could communicate as easily with each other as if they were all gathered together in a face-to-face meeting. This vision of telepresence has blown new life into the research and development of video-teleconferencing systems, where great efforts are being put into the development of methods for creating a perceived spatial awareness that resembles that of an actual face-to-face meeting One important factor of a real life conversation is the ability of the human species to locate participants by using only the sound information. Spatial audio, which is explained in more detail below, is sound that contains binaural cues, and those cues are used to locate sound sources. In a teleconference that uses spatial audio, it is possible to arrange the participants in a virtual meeting room, where every participant's voice is perceived as if it originated from a specific direction. When a participant can locate other participants in the stereo image, it is easier to focus on a certain voice and to determine who is saying what.

In a teleconference application that supports spatial audio, a conference bridge in the network is able to deliver spatialized (3D) audio rendering of a virtual meeting room to each of the participants. The spatialization enhances the perception of a face-to-face meeting and allows each participant to localize the other participants at different places in the virtual audio space rendered around him/her, which again makes it easier for the participant to keep track of who is saying what.

A teleconference can be created in many different ways. One may listen to the conversation through headphones or loudspeakers using stereo or mono signals. The sound may be obtained by a microphone utilizing either stereo or mono signals. The stereo microphone can be used when several participants are in the same physical room and the stereo image in the room should be transferred to the other participants located somewhere else. The people sitting to the left are perceived as being located to the left in the stereo image. If the microphone signal is in mono then the signal can be transformed into a stereo signal, where the mono sound is placed in a stereo image. The sound will be perceived as having a placement in the stereo image, by using spatialized audio rendering of a virtual meeting room.

For participants of an advanced multimedia terminal the spatial rendering can be done in the terminal, while for participants with simpler terminals the rendering must be done by the conference application in the network and delivered to the end user as a coded binaural stereo signal. For that particular case, it would be beneficial if standard speech decoders that are already available on the standard terminals could be used to decode the coded binaural signal.

A codec of particular interest is the so called Algebraic Code Excited Linear Prediction (ACELP) based Adaptive Multi-Rate Wide Band (AMR-WB) coder [1-2]. It is a mono-decoder, but it could potentially be used to code the left and right channels of the stereo signal independently of each other.

Listening tests of AMR-WB coded teleconference related stereo recordings and synthetically rendered binaural signals have shown that the codec often introduces coding artifacts that are quite disturbing and distort the spatial image of the sound signal. The problem is more severe for the modes operating at a low bit rate, such as 12.65 kbs, but is even found in modes operating at higher bit rates. The stereo speech signal is coded with a mono speech coder where the left and right channels are coded separately. It is important that the coder preserve the binaural cues needed to locate sounds. When stereo sounds are coded in this manner, strange artifacts can sometimes be heard during simultaneous listening to both channels. When the left and right channels are played separately, the artifacts are not as disturbing. The artifacts can be explained as spatial noise, because the noise is not perceived inside the head. It is further difficult to decide where the spatial noise originates from in the stereo image, which is disturbing to listen to for the user.

A more careful listening of the AMR-WB coded material has revealed that the problems mainly arise when there is a strong high pitched vowel in the signal or when there are two or more simultaneous vowels in the signal and the encoder has problems estimating the main pitch frequency. Further signal analysis has also revealed that the main part of the above mentioned signal distortion lies in the low frequency area from 0 Hz to right below the lowest pitch frequency in the signal.

If the AMR-WB codec is to be used as described above, it is necessary to enhance the coded signal in the low frequency range described above.

Voiceage Corporation has developed a frequency-selective pitch enhancement of synthesized speech [3-4]. However, listening tests have revealed that the method does not manage to enhance the coded signals satisfactorily, as most of the distortion could still be heard. Recent signal analysis of the method has shown that it only enhances the frequency range immediately around the lowest pitch frequency and leaves the major part of the distortion, which lies in the frequency range from 0 Hz to right below the lowest pitch frequency, untouched.

Due to the above, there is a need for methods and arrangements enabling enhancement of ACELP encoded signals to reduce the spatial noise.

SUMMARY

A general object of the present invention is to enable improved teleconferences.

A further object of the present invention is to enable improved enhancement of spatial audio signals.

A specific object of the present invention enables improved enhancement of ACELP coded spatial signals in a teleconference system.

Basically, the present invention discloses a method of enhancing received spatial audio signals, e.g. ACELP coded audio signals in a teleconference system. Initially, an ACELP coded audio signal comprising a plurality of blocks is received (S10). For each block a signal type is estimated (S20) based on the received signals and/or a set of decoder parameters. Also, for each block a pitch frequency is estimated (S30) based on the received signal and/or the set of decoder parameters. Subsequently, filtering parameters are determined (S40) based on at least one of the estimated signal type and said estimated pitch frequency. Finally, the received signal is high pass filtered (S50) based on the determined filter parameters to provide a high pass filtered output signal.

For a further embodiment, all channels of a multi channel audio signal are subjected to the estimation steps and subsequently determining S41 joint filter parameters for the channels. Finally, all channels are high-pass filtered using the same joint filter parameters.

Advantages of the present invention comprise:

Enhanced spatial audio signals.

Spatial audio signals with reduced spatial noise.

Improved teleconference sessions.

BRIEF DESCRIPTION OF THE DRAWINGS

The invention, together with further objects and advantages thereof, may best be understood by referring to the following description taken together with the accompanying drawings, in which.

ABBREVIATIONS

ACELP Algebraic Code Excited Linear Prediction

AMR-WB Adaptive Multi-Rate Wide Band

AMR-WB+ Extended Adaptive Multi-Rate Wide Band

FIR Finite Impulse Response

Hz Hertz

IIR Infinite Impulse Response

MUSHRA Multiple Stimuli with Hidden Reference and Anchor

WB Wide Band

VMR-WB Variable Rate Multi-Mode Wide Band

DETAILED DESCRIPTION

The present invention will be described in the context of Algebraic Code Excited Linear Prediction (ACELP) coded signals in Adaptive Multi-Rate Wide Band (AWR_WB). However, it is appreciated that it can equally be applied to other similar systems utilizing ACELP.

When the inventors have tested the prior art Voiceage method on teleconference related material, the known method has not managed to enhance the coded signals satisfactorily. Signal analysis of the method has shown that it only enhances the frequency range immediately around the lowest pitch frequency and leaves the major part of the distortion, which lies in the frequency range from 0 Hz to right below the lowest pitch frequency, untouched.

In order to enable improved enhancement of spatial audio signals, the inventors have discovered that it is necessary to reduce or even eliminate the above described distortion by high pass filtering the coded signal with a time-varying high-pass filter, where for each signal block the cutoff frequency of the high pass filter is updated as a function of the estimated signal type and pitch frequencies of the signal block. In other words, the present disclosure generally relates to a method of high pass filtering a spatial signal with a time varying high pass filter in such a manner that it follows the pitch of the signal.

Figure 1:
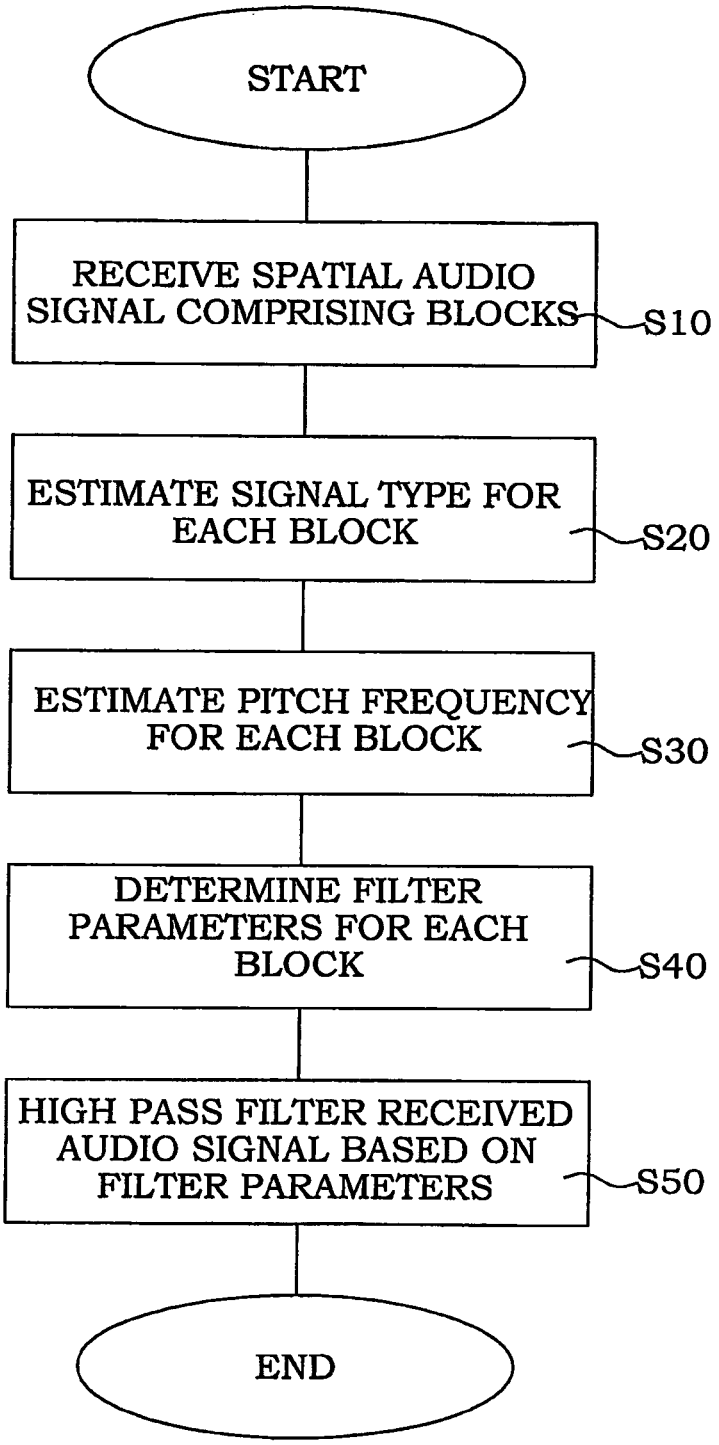
FIG. 1 is a schematic flow diagram of an embodiment of the present invention.

With reference to FIG. 1, an audio signal, e.g. an ACELP coded signal, comprising a plurality of blocks is received S10. Each block of the received signal is subjected to an estimation process in which a signal type S20 is estimated based on the received signal and/or a set of decoder parameters. Subsequently, or in parallel, a pitch frequency S30 for the block is estimated, also based on one or both of the received signals and the decoder parameters. Based on the estimated pitch and/or signal type a set of filtering parameters S40 are determined for the block. Finally, the received signal is high pass filtered S50 based on the determined filter parameters to provide a high pass filtered output audio signal.

According to a further embodiment, the high pass filtering is enabled by means of one or optionally a sequence of filters (or parallel filters). Potential filters to use comprise: Finite Impulse Response (FIR) filters, (Infinite Impulse Response) IIR filters. Preferably, a plurality of parallel RR filter(s) of elliptical type are utilized. In one preferred embodiment, three parallel HR filters are used for enabling the high pass filtering process.

Figure 2:
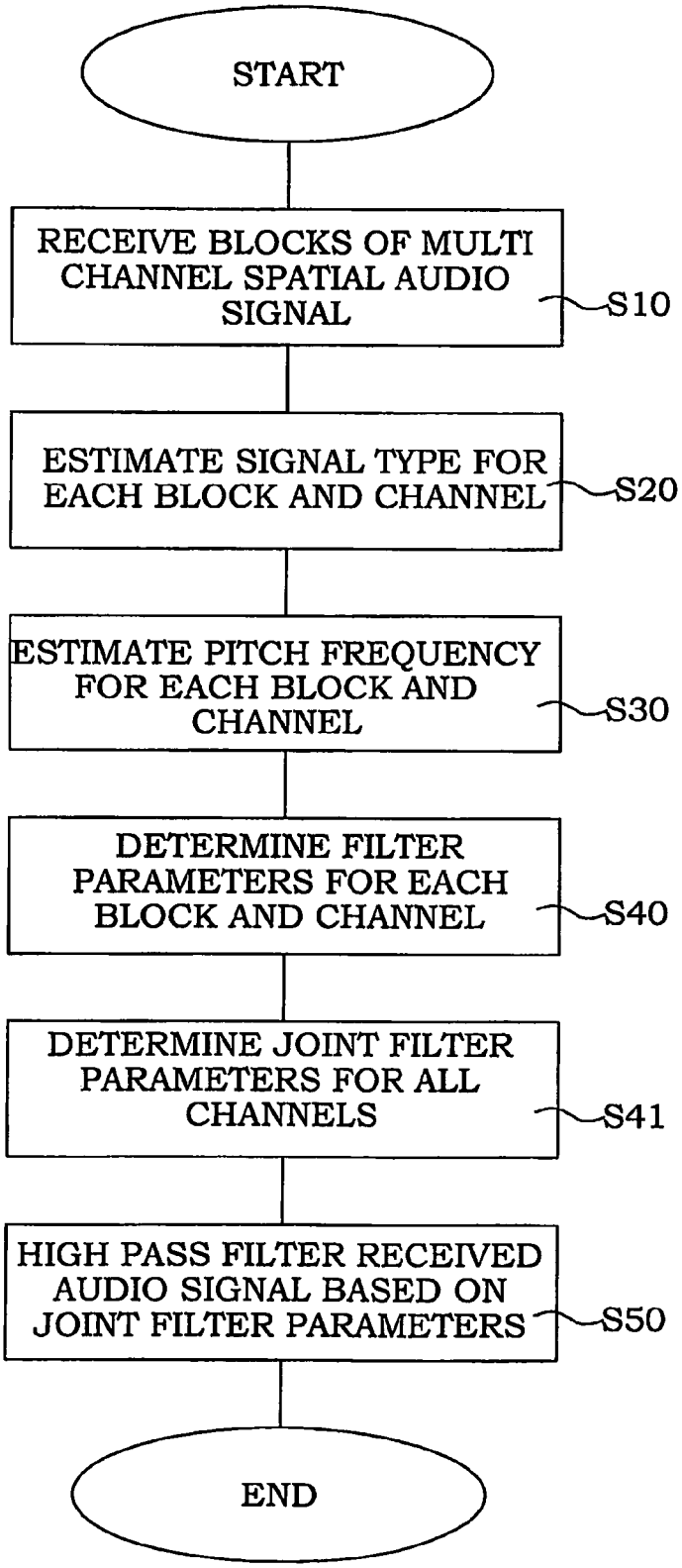
FIG. 2 is a schematic flow diagram of a further embodiment of the present invention.

Specifically, and with reference to FIG. 2, according to a further embodiment of the present invention a multi channel spatial audio signal is provided or received S10. For each block and channel, the signal type and the pitch frequency are determined or estimated S20, S30. Subsequently, filter parameters are determined for each channel S40 and additionally, joint filter parameters are determined S41 for the blocks and channels. Finally, all channels of the multi channel spatial audio signal are high pass filtered (S50) based on the determined joint filter parameters. A special case of the multi channel signal is a stereo signal with two channels.

The step of determining joint filter parameters S41 is, according to a specific embodiment, enabled by determining a cut off frequency for each channel based on the estimated signal type and pitch frequency, and forming the joint filter parameters based on a lowest cut off frequency. Also other frequency criteria can be utilized in the process.

According to a possible further embodiment (not shown) of the present invention, the filter parameters are determined solely based on the estimated signal type. The pitch estimation step S30, in that case, comprises the additional step of determining if it is necessary to add the pitch estimation to determine more accurate filter parameters. If the determining step reveals that such is the case, the pitch is estimated and the filter parameters are determined based on both signal type and pitch. If the pitch estimation step is deemed superfluous, then the filter parameters are determined based only on the signal type.

Figure 3A:
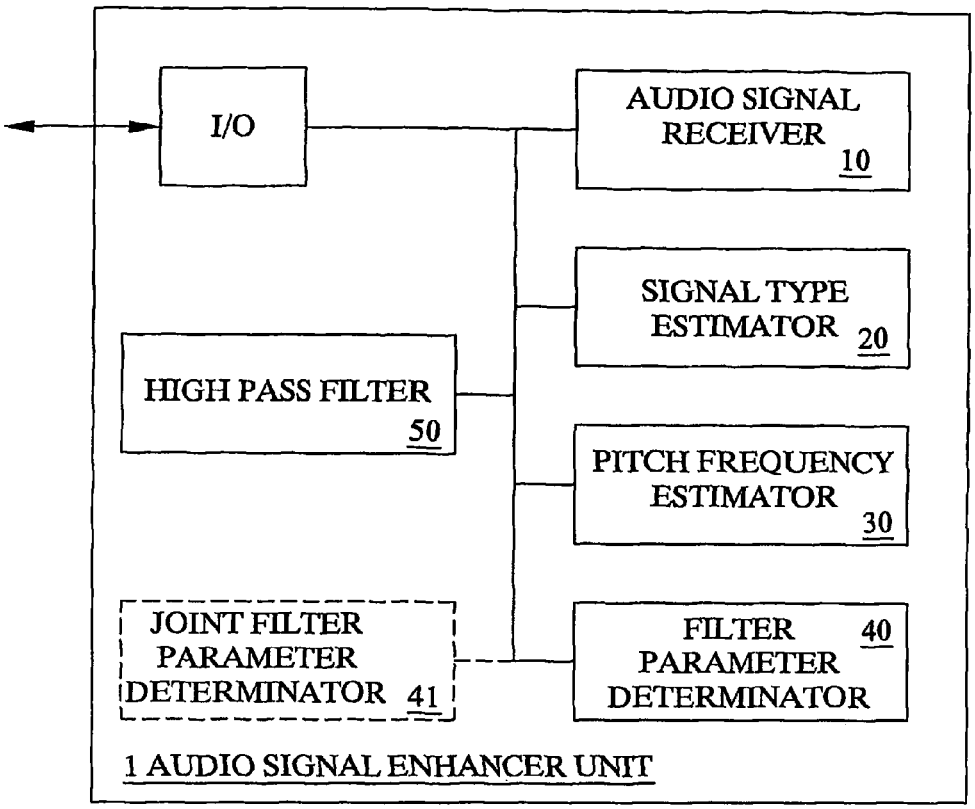
FIG. 3*a* is a schematic block diagram of an arrangement according to the present invention.

With reference to FIG. 3*a*, an embodiment of an arrangement 1 for enhancing spatial audio signals according to the present invention will be described below.

In addition to illustrated units the arrangement 1 may contain any (not shown) units necessary for receiving and transmitting spatial audio signals. These are indicated by the general input/output I/O box in the drawing. The arrangement 1 comprises a unit 10 for providing or receiving a spatial audio signal, the signal being arranged as a plurality of blocks. A further unit 20 provides estimates of the signal type for each received block, based on provided decoder parameters and the received signal block. Subsequently, or in parallel, a pitch estimating unit 30 estimates the pitch frequency of the received signal block, also based on provided decoder parameters and the received signal block. A filter parameter determining unit 40 is provided. The unit 40 uses the estimated signal type and/or the estimated pitch frequency to determine suitable filter parameters for a high-pass filter unit 50.

According to a further embodiment, the arrangement 1 is further adapted to utilize the above described units to enhance stereo or even multi-channel spatial audio signals. For that case, the units 20, 30 for estimating signal type and pitch frequency is adapted to perform the estimates for each channel of the multi-channel signal. Also, the filter unit 40 (or an alternative filter unit 41) is adapted to utilize the determined respective filter parameters (or directly the estimated pitch and signal type) to determine joint filter parameters. Finally, the high pass filter 50 is adapted to high-pass filter all of the multiple channels of the received signal with the same joint filter parameters.

The boxes depicted in the embodiment of FIG. 3*a* can be implemented in software or equally well in hardware, or a mixture of both.

Figure 3B:
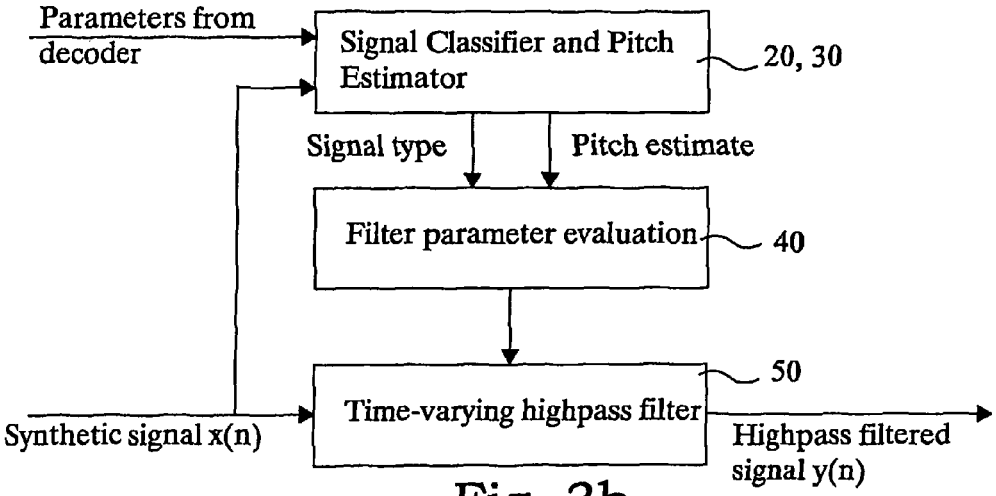
FIG. 3*b* is a schematic block diagram of an arrangement according to the present invention.

According to a further embodiment, an arrangement of the present invention comprises a first block in FIG. 3*b* that is the Signal classifier and Pitch estimator 20, 30 block, which for each signal block of the received signal as represented by the synthetic signal x(n), estimates the signal type and pitch frequencies of the signal block from a set of decoder parameters as well as the synthetic signal itself. The Filter parameter evaluation block 40 then takes the estimated signal type and pitch frequencies and evaluates the appropriate filter parameters for the high pass filter. Finally the Time-varying high-pass filter block 50 takes the updated filter parameters and performs the high-pass filtering of the synthetic signal x(n).

In general the method will use both parameters form the decoder as well as the synthetic signal when estimating the signal type and pitch frequencies, but could also opt to use only one or the other.

As the signal of interest is a stereo signal and the decoder is a mono decoder, the signal classification and pitch estimation is performed for both the left and right channels. However, as it is important not to distort the spatial image of the stereo signal, both channels need to be filtered with the same time-varying high-pass filter. The method therefore decides which channel requires the lowest cutoff frequency (based on the determined respective filter parameters for each channel) and uses that cutoff frequency when evaluating the filter coefficients of the joint high-pass filter that is used to filter both channels.

In one embodiment of the invention, the signal type classification is very simple. It simply determines if the signal block contains a strong and narrow band-pass component of low center frequency in the typical frequency range of the human pitch, approximately 100-500 Hz. If such a narrow band-pass component is found the center frequency of the component is estimated as the lowest pitch frequency of the signal block. The filter cut-off frequency is evaluated right below that lowest pitch frequency and the filter parameters for that cutoff frequency are evaluated and sent to the time-varying high-pass filter. When no narrow band-pass component is found the cut-off frequency is decreased towards 50 Hz.

To get this kind of time-varying high-pass filtering to work properly and to obtain an efficient implementation of it, there are several design issues that need to be carefully considered. Here is a list of the most important issues.

1. The high pass filter should be adapted to suppress the undesired noise below the lowest pitch frequency without distorting the pitch component. This requires a sharp transition between the stop-band and the pass-band.

2. The filtering needs also to be effectively computed, which requires as few filter parameters as possible.

3. To efficiently fulfill requirements 1 and 2 the so called IIR filter structure can be chosen according to one embodiment. By testing the method of the invention, it has been established that reasonably good results are obtained by using 6-th order elliptical filters.

4. Stability of time-varying IIR filtering is a non-trivial matter. To guarantee stability the 6-th order IIR filters they can be decomposed into three 2-nd order filters, which gives full control over the poles of each 2-nd order filter and thus guarantees the stability of the complete filtering operation.

Even though these filter design solutions have been used in one embodiment of the invention, they are in no way restrictive to the invention. Someone skilled in the art easily recognizes that other filter structures and stability control mechanisms could be used instead.

ADVANTAGES OF THE INVENTION

The performance of the invention in comparison to non-enhanced coded signals and other enhancement methods has been evaluated through a MUSHRA [5] listening test on two sets of test signals. The first set of signals contained signals that had severe coding distortions while the second set contained signals without any severe distortions. With the first set, the objective was to evaluate how big an improvement the enhancement method described in this invention was delivering, while the second set of signals was used to show if the enhancement method caused any audible degradation to signals that did not have any severe coding distortions.

The coders and enhancement methods evaluated in the test are summarized in Table 1 below.

TABLE 1

Comparison of enhancement methods

| Output Signal | Coding and enhancement |
|---|---|
| ref | Uncoded original signal |
| mode7filt | AMR-WB, 23.05 kbit/s and filtered according to the invention. |
| mode7 | AMR-WB, 23.05 kbit/s. |
| mode2filt | AMR-WB, 12.65 kbit/s and filtered according to the invention |
| mode2 | AMR-WB, 12.65 kbit/s. |
| bpf2 | AMR-WB, 12.65 kbit/s and filtered with the pitch enhancer of Voiceage. |
| wb+ | AMR-WB+, 13.6 kbit/s, with a fixed frame of 20 ms. The AMR-WB+ was forced to only code in ACELP mode [6]. |
| vmr | VMR-WB, 12.65 kbit/s [7]. |
| anchor | Original uncoded signal that is low-pass filtered at 3.5 kHz. |

Figure 4:
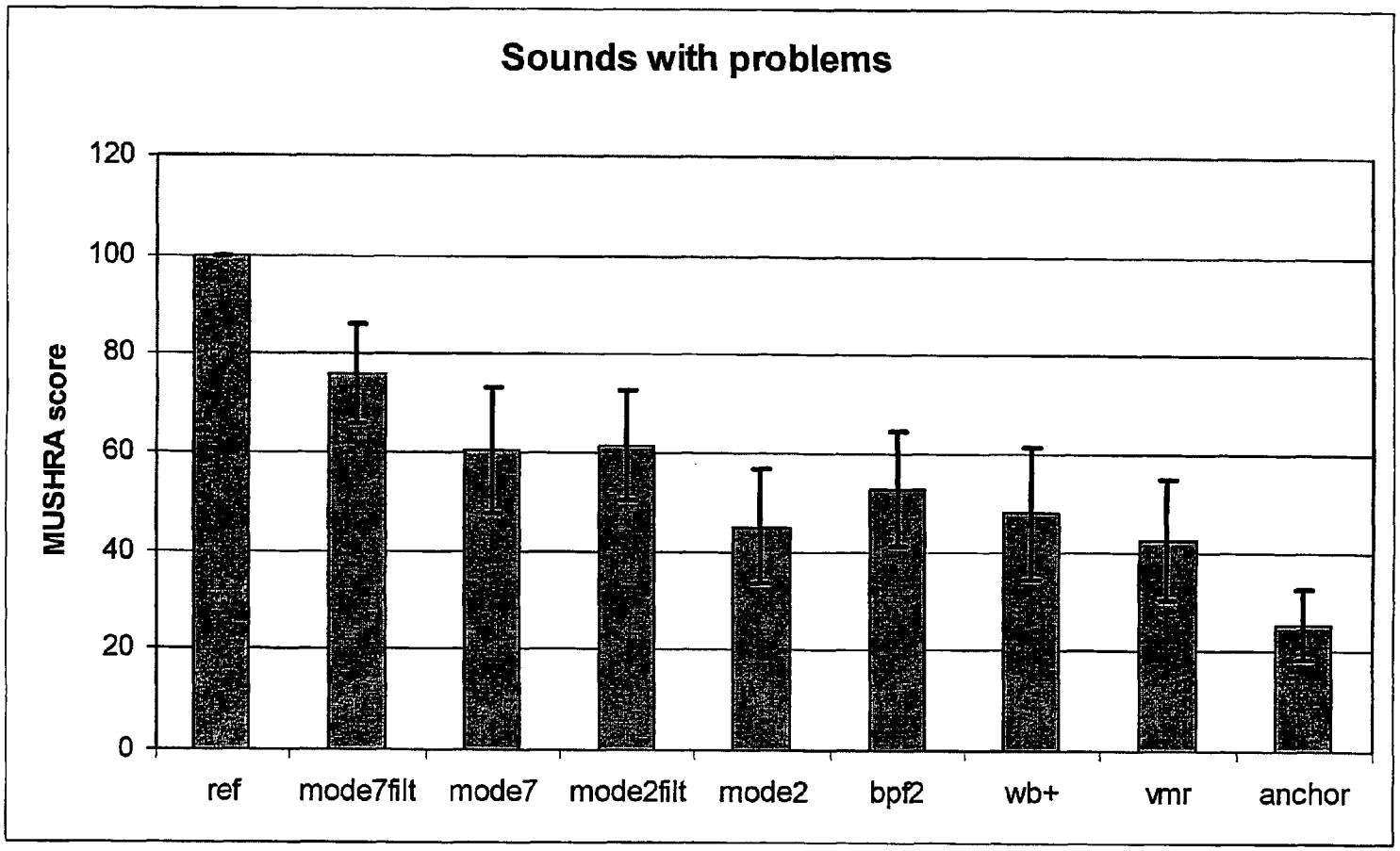
FIG. 4 is a diagram of a comparison between enhancement according to the present invention and known MUSHRA test for a signal with distortions.
Figure 5:
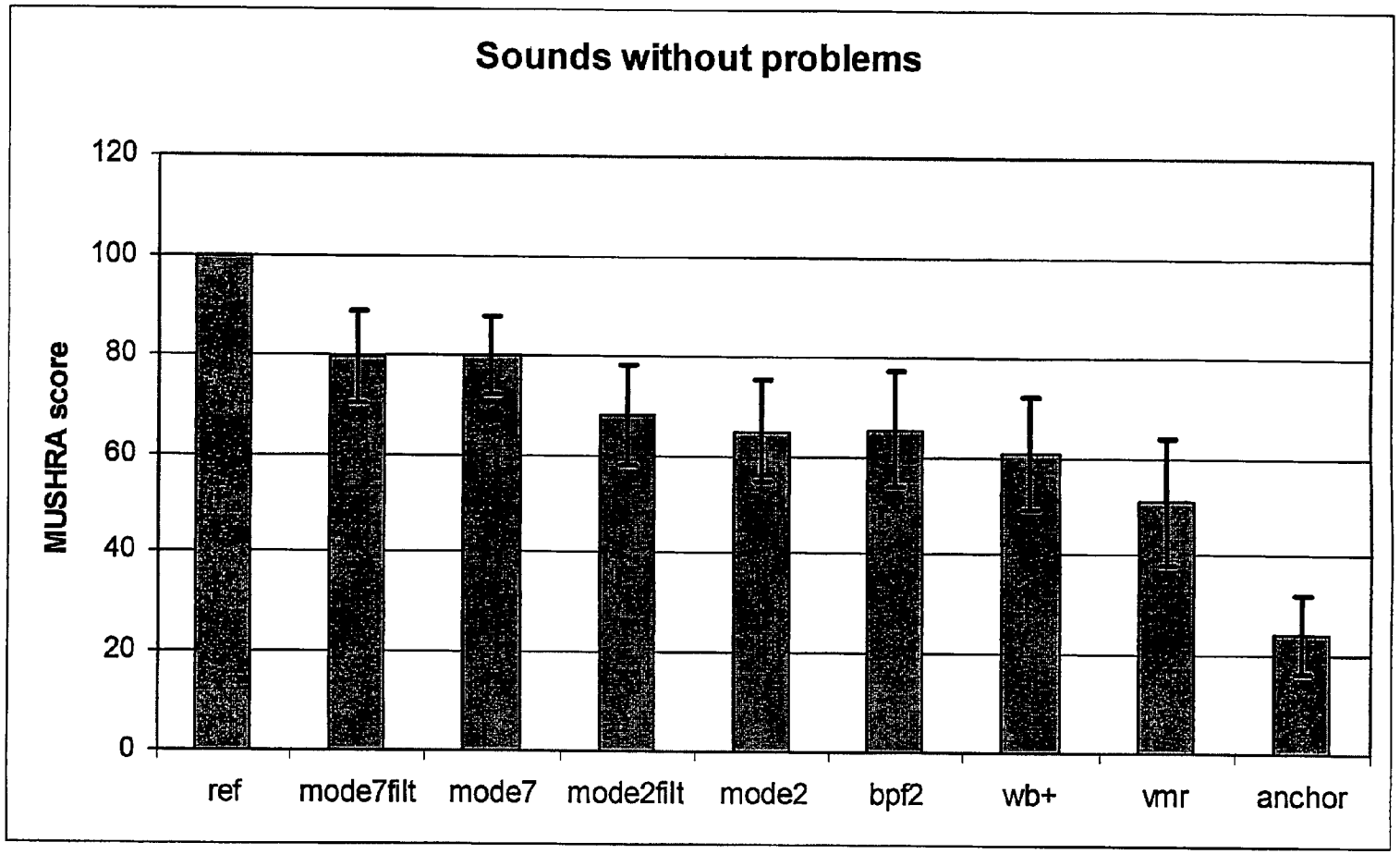
FIG. 5 is a diagram of a comparison between enhancement according to the present invention and known MUSHRA test for a signal without distortions.

The results from the MUSHRA test are given in FIG. 4 and FIG. 5. FIG. 4 shows the results for a set of signals with severe coding distortions, while FIG. 5 shows the results for a set of signals without any severe coding artifacts.

From FIG. 4 it can be seen that the enhancement method of this invention improves the quality of the coded signals by approximately 15 MUSHRA points for both mode 2 and mode 7 of the AMR-WB coded material, which is a significant improvement. FIG. 4 also shows that the enhanced mode 2 obtains approximately the same MUSHRA score as mode 7 does, which requires twice the bitrate of mode 2. This shows that the enhancement method is working very well and that the low bitrate of 12.65 kbps bitrate per channel could be satisfactorily used to code stereo and binaural signals for teleconference applications that support spatial audio.

The results in FIG. 5 clearly show that the enhancement method according to the present invention is not adding any audible distortions to the test material that did not have any severe coding distortions, which is also an important issue for the enhancement method.

With these results, it is clear that the enhancement method is delivering significant improvement of the distorted coded signals and that with these improvements of e.g. the AMR-WB codec combined with the enhancement method of this invention can be successfully used in teleconference applications for delivering stereo recorded or synthetically generated binaural signals. Without the enhancement method, on the other hand, the quality of the stereo or binaural signals delivered by the AMR-WB decoder would be too low for the intended application.

It will be understood by those skilled in the art that various modifications and changes may be made to the present invention without departure from the scope thereof, which is defined by the appended claims.

REFERENCES

[1] 3GPP, July 2005. TS 26.190 v6.1.1 (2005-07), *Speech codec speech processing function, Adaptive Multi-Rate-Wideband (AMR-WB) speech codec, Release* 6.

[2] Bruno Bessette, Redwan Salami, Roch Lefebvre, Milan Jelínek, Jani Rotola-Pukkila, Janne Vainio, Hannu Mikkola, Kari Järvinen. November 2002. *The Adaptive Multirate Wideband Speech Codec (AMR-WB), IEEE Transaction on speech and audio processing, vol* 10, no 8.

[3] 3GPP, 2007-03, TS 26.290 V7.0.0, Page 57.

[4] Patent Application WO 03/102923 A2.

[5] ITU-R Recommendation BS. 1535-1, 2001, *Method for the Subjective Assessment of Intermediate Sound Quality (MUSHRA)*, International Telecommunications Union, Geneva, Switzerland.

[6] 3GPP, 2007-03. TP 26.290 v7.0.0, *Audio codec processing functions; Extended Adaptive Multi-Rate-Wideband (AMR-WB+)* codec, Release 6.

[7] 3GPP2, 2005-04. C.S0052-A v1.0, *Source-Controlled Variable-Rate Multimode Wideband Speech Codec (VMR-WB)*.

What is claimed is:

1. A method of enhancing spatial audio signals, comprising:

receiving an Algebraic Code Excited Linear Prediction (ACELP) coded audio signal comprising a plurality of blocks;

for each received block, estimating a signal type based on at least one of the received signal and a set of decoder parameters, wherein estimating the signal type comprises:

determining if the signal block comprises a strong and narrow band-pass component of a human pitch with a center frequency in the range of 100-500 Hz; and estimating a center frequency as a lowest pitch frequency of the signal block if it is determined that the signal block includes the narrow band-pass component;

estimating a pitch frequency based on at least one of the received signal and the set of decoder parameters;

determining filtering parameters based on at least one of the estimated signal type and the estimated pitch frequency, wherein the filtering parameters include a cut-off off frequency, wherein the cut-off frequency is set below the lowest pitch frequency if it is determined that the signal block includes the narrow band-pass component and wherein the cut-off frequency is decreased towards 50 Hz if it is determined that the narrow signal block does not include the narrow band-pass component; and high pass filtering the received signal based on the determined filter parameters to provide a high pass filtered output signal.

2. The method according to claim 1, further comprising performing the estimating steps and the determining step for each channel of a multi channel input signal, wherein the determining step further comprises forming joint filter parameters based on the respective determined filter parameters for the multiple channels, and high pass filtering all the channel signals based on the joint filter parameters.

3. The method according to claim 2, wherein forming joint filter parameters further comprises determining a cut off frequency for each channel based on the estimated signal type and pitch frequency, and forming the joint filter parameters based on a lowest cut off frequency.

4. The method according to claim 2, wherein the multi channel input signal being a stereo signal.

5. The method according to claim 1, wherein the pitch estimation step further comprises determining if pitch estimation is needed, and performing the pitch estimation based on the determining step.

6. The method according to claim 5, wherein if the determining step necessitates pitch estimation, estimating the pitch of the received signal and determining the filtering parameters based on both of the estimated signal type and the estimated pitch frequency.

7. The method according to claim 1, wherein the spatial signal is an Adaptive Multi-Rate Wide Band (AMR-WB) ACELP signal.

8. An arrangement for enhancing received spatial audio signals, comprising an audio signal receiver for receiving an Algebraic Code Excited Linear Prediction (ACELP) coded audio signal having a plurality of blocks;

a signal type estimator for estimating a signal type for each signal block based on at least one of the received signal and a set of decoder parameters, the signal type estimator being further for:

determining if the signal block has a strong and narrow band-pass component of a human pitch with a center frequency in the range of 100-500 Hz; and estimating a center frequency as a lowest pitch frequency of the signal block if it is determined that the signal block includes the narrow band-pass component;

a pitch frequency estimator configured to estimate a pitch frequency for each signal block based on at least one of the received signal and the set of decoder parameters;

a filter parameter determinator for determining filtering parameters based on the estimated signal type and the estimated pitch frequency, wherein the filtering parameters include a cut-off frequency, wherein the cut-off frequency is set below the lowest pitch frequency if it is determined that the signal block includes the narrow band-pass component and wherein the cut-off frequency is decreased towards 50 Hz if it is determined that the narrow signal block does not include the narrow band-pass component; and a high pass filter for high pass metering the received signal based on the determined filter parameters to provide a high pass filtered output signal.

9. The arrangement according to claim 8, wherein the signal type estimator, pitch frequency estimator and the filter parameter determinator are configured to perform estimate pitch and signal type for each channel of a multi channel input signal, and the filter parameter determinator further comprises a joint filter parameter determinator for forming joint filter parameters based on the respective determined filter parameters for the multiple channels, and the high pass filter configured to filter all the channel signals based on the joint filter parameters.

10. The arrangement according to claim 8, wherein the high pass filter comprises a plurality of filters.

11. The arrangement according to claim 10, wherein the filters comprise one of Finite Impulse Response filters and Infinite Impulse Response filters.

12. The arrangement according to claim 10, wherein, the filters comprise elliptical Infinite Impulse Response filters.

* * * * *

UNITED STATES PATENT AND TRADEMARK OFFICE

CERTIFICATE OF CORRECTION

PATENT NO. : 8,639,501 B2
APPLICATION NO. : 12/665812
DATED : January 28, 2014
INVENTOR(S) : Karlsson et al.

It is certified that error appears in the above-identified patent and that said Letters Patent is hereby corrected as shown below:

In the Specification

Column 1, Line 34, delete "meeting" and insert -- meeting. --, therefor.

Column 4, Line 33, delete "RR" and insert -- IIR --, therefor.

Column 4, Line 35, delete "HR" and insert -- IIR --, therefor.

In the Claims

Column 8, Lines 12-13, in Claim 1, delete "cut-off off" and insert -- cut-off --, therefor.

Column 8, Line 50, in Claim 8, delete "comprising" and insert -- comprising: --, therefor.

Column 9, Line 29, in Claim 12, delete "wherein," and insert -- wherein --, therefor.

Signed and Sealed this
Sixteenth Day of September, 2014

Michelle K. Lee

Michelle K. Lee
*Deputy Director of the United States Patent and Trademark Office*